US006435105B1

(12) United States Patent
Mikich et al.

(10) Patent No.: US 6,435,105 B1
(45) Date of Patent: Aug. 20, 2002

(54) SUSPENDED STORAGE STRUCTURE

(75) Inventors: Michael J. Mikich; Timothy M. Matthias; Mark C. Torosian; Dwayne Dunseath, all of Las Vegas, NV (US)

(73) Assignee: Hyloft USA, LLC, Las Vegas, NV (US)

( * ) Notice: Subject to any disclaimer, the term of this patent is extended or adjusted under 35 U.S.C. 154(b) by 37 days.

(21) Appl. No.: 09/690,654

(22) Filed: Oct. 17, 2000

(51) Int. Cl.[7] ..... A47B 23/00
(52) U.S. Cl. ..... 108/42; 211/113
(58) Field of Search ..... 108/42, 186; 211/113, 211/118, 117, 119; 52/39

(56) References Cited

U.S. PATENT DOCUMENTS

| | | | | |
|---|---|---|---|---|
| 1,566,551 A | * | 12/1925 | Ghrand | 108/186 |
| 3,938,666 A | * | 2/1976 | Castleberry | 211/113 X |
| 4,167,908 A | * | 9/1979 | Jones et al. | 108/186 |
| 4,289,392 A | | 9/1981 | Kobori et al. | |
| 4,374,498 A | * | 2/1983 | Yellin | 108/42 X |
| 4,441,583 A | * | 4/1984 | Vaught | 211/113 X |
| 5,011,239 A | | 4/1991 | Guerin | |
| 5,056,878 A | | 10/1991 | Givens | |
| 5,199,843 A | | 4/1993 | Sferra | |
| 5,203,619 A | | 4/1993 | Welsch et al. | |
| 5,215,366 A | | 6/1993 | Givens | |
| 5,242,219 A | | 9/1993 | Tomaka | |
| 5,727,700 A | | 3/1998 | Digney | |
| D416,152 S | | 11/1999 | Payne et al. | |
| 6,145,678 A | * | 11/2000 | Morrison | 211/113 |
| 6,286,691 B1 | * | 9/2001 | Oberhaus et al. | 211/113 X |
| 6,311,626 B1 | * | 11/2001 | Roberts | 108/42 |

FOREIGN PATENT DOCUMENTS

FR 2526648 * 11/1983

* cited by examiner

*Primary Examiner*—Jose V. Chen
(74) *Attorney, Agent, or Firm*—Quirk & Tratos

(57) ABSTRACT

An overhead storage assembly, vendable as a kit, includes a plurality of panels each of a rectangular planform having dimensions that are integer multiples of conventional structural spacing. The panels may be joined to each other to form a common support surface resting on a plurality of transverse support pieces connected at the ends to hanger assemblies that are attached to the overhead structure of a building. Each panel, moreover, may include off-set elements to increase the sectional stiffness of the panel and the hanger assemblies may comprise matching upper and lower straps that are secured to each other at selected suspension lengths.

11 Claims, 4 Drawing Sheets

SUSPENDED STORAGE STRUCTURE

BACKGROUND OF THE INVENTION

1. Field of the Invention

The present invention relates to storage structures, and more particularly to overhead storage structures conformed for suspended attachment.

2. Description of the Prior Art

Overhead storage structures have been known in the past. Typically the cost and maintenance of storage space are directly related to floor space. As a consequence storage of personal articles is associated with the costs of the housing structure, and the hobbyist, artist, or collector is often forced with the hard choice between cost of storage and artistic pursuit. Similarly, artisans, mechanics and those engaged in business are always exchanging tool or merchandise inventory against the cost of its storage. Accessible storage is therefore uniformly sought.

In the past various storage structures have been devised which in one way or another are deployed overhead. Amongst these are structures associated with lifting mechanisms for raising and lowering the storage assembly, as exemplified in U.S. Pat. No. 5,203,619 to Welsch et al and U.S. Pat. No. 5,199,843 to Sferra. Each of the foregoing, while suitable for the purposes intended, describes a fairly complex structure that is devoted to lift, and store substantial overhead weights.

Alternatively, other passive or manually articulated overhead storage arrangements have been devised as exemplified in U.S. Pat. No. 5,011,239 to Guerin and U.S. Pat. Nos. 5,215,366 and 5,056,878 to Givens. Again, while suitable for the purposes intended, each of the foregoing entails substantial structural elements which often extend from the ceiling to the floor or present a formidable visual mass that creates the appearance of crowding.

In the recent past, U.S. Pat. No. Des. 416,152 has been issued to Sidney Thomas Payne describing an ornamental welded wire constructed storage structure suspended on spaced welded wire supports tied to a ceiling. While the welded wire structural implementation provides a somewhat less visually encumbered appearance, further improvements are possible both in the nature of the accommodation thereof to the available spaces and in the manner in achieving positive suspension engagement directly to structural elements and beams. It is these improvements that are disclosed herein.

SUMMARY OF THE INVENTION

Accordingly, it is the general purpose and object of the present invention to provide an overhead storage structure variously formed from standardized welded wire segments.

Other objects of the invention are to provide welded wire modular components that are combined to form overhead storage.

Yet further objects of the invention are to provide a light weight overhead storage assembly that is conveniently suspended from overhead beams.

Briefly, these and other objects are accomplished within the present invention by providing a standardized welded wire module each defined by a welded wire panel reinforced along both longitudinal edges by a spaced and offset wire element. Several of these modules can then be joined to each other to form a support surface stiffened at the common longitudinal sides by the above described offset wire element.

To provide transverse stiffness, the joined modules are supported by spaced transverse pieces each fixed at the ends to a corresponding lower end of a paired set of support straps, which, at the upper end each strap is then attached to an adapter which is secured to a ceiling beam or other structural member. Each of the straps, in turn, comprises an upper end and a lower overlapping segment fastened to each other by known fasteners such as a nut and a bolt. To allow for fine vertical length adjustment of each of the straps, the respective upper and lower segments may each include a series of evenly spaced bolt openings for fastening the straps to each other at the correct height deployment.

At the upper end, the upper strap segment is again secured by a bolt to a selected opening in the vertical surface of an L-sectioned adapter which, at the horizontal surface, is securable by a screw or bolt directly to the structure of an overhead beam. The several fastening openings in both the vertical and horizontal surfaces of the adapter allow for a substantial offset between the attachment of the strap and the beam fastening, thereby accommodating a fairly wide scope of choices for the deployment of the inventive storage assembly.

In those instances where a fairly large offset is required between the beam attachment and the attachment of the suspension strap triangulation links may be utilized to limit any adapter loading in cantilever or bending. Again, the links may be pierced with fastener openings at several intervals relative the piercings in the strap segments to accommodate variations in the resulting geometry.

Preferably each of the welded wire modules is dimensioned in integer multiples of standard structural beam spacing and the offset allowable in each adapter is a fraction thereof. In consequence the inventive storage structure can be variously positioned along walls or in other alignments that minimize its optical bulk.

DESCRIPTION OF THE PREFERRED EMBODIMENT

Figure 1:
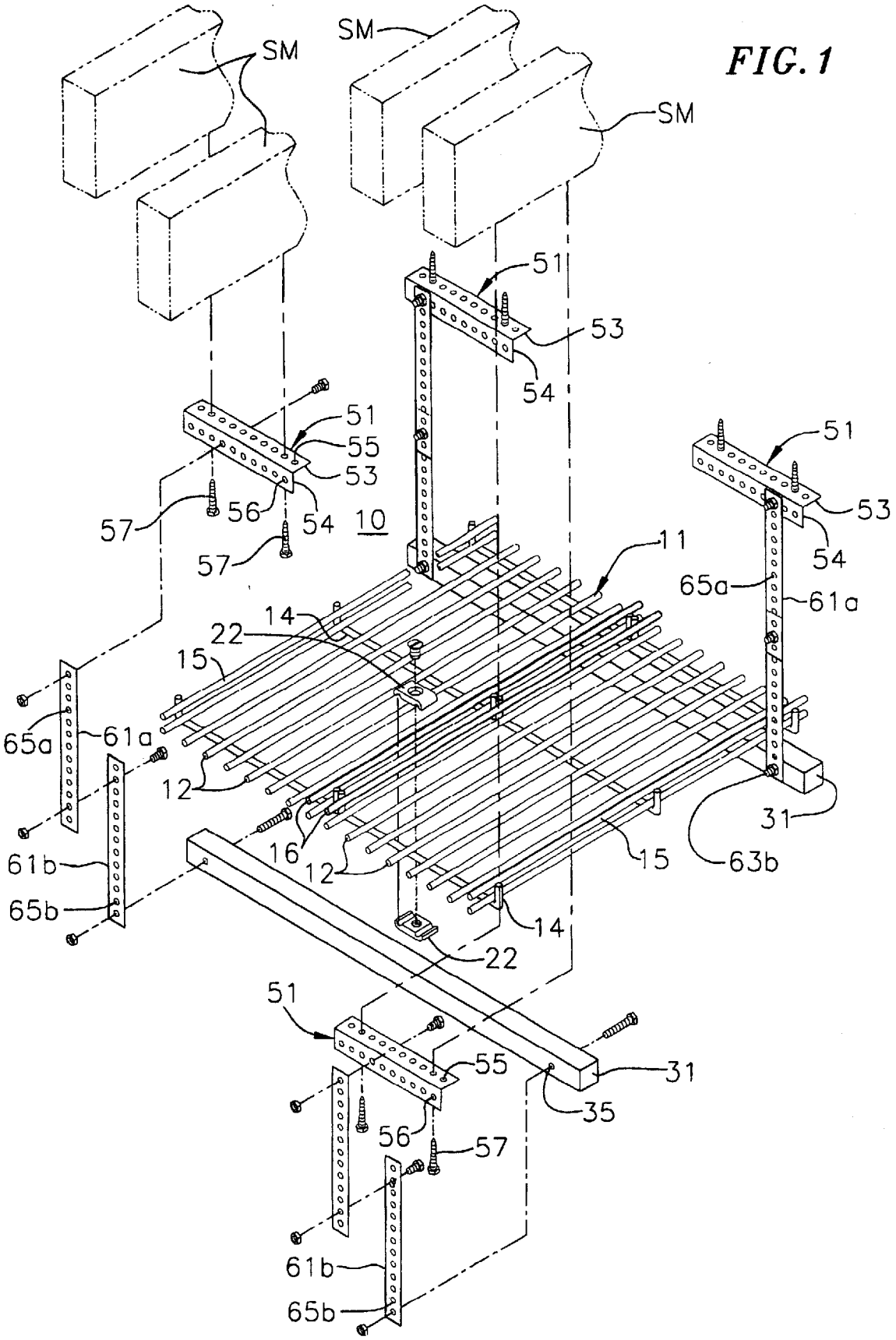
FIG. 1 aperspective illustration, separated by parts of the inventive overhead storage structure.
Figure 2:
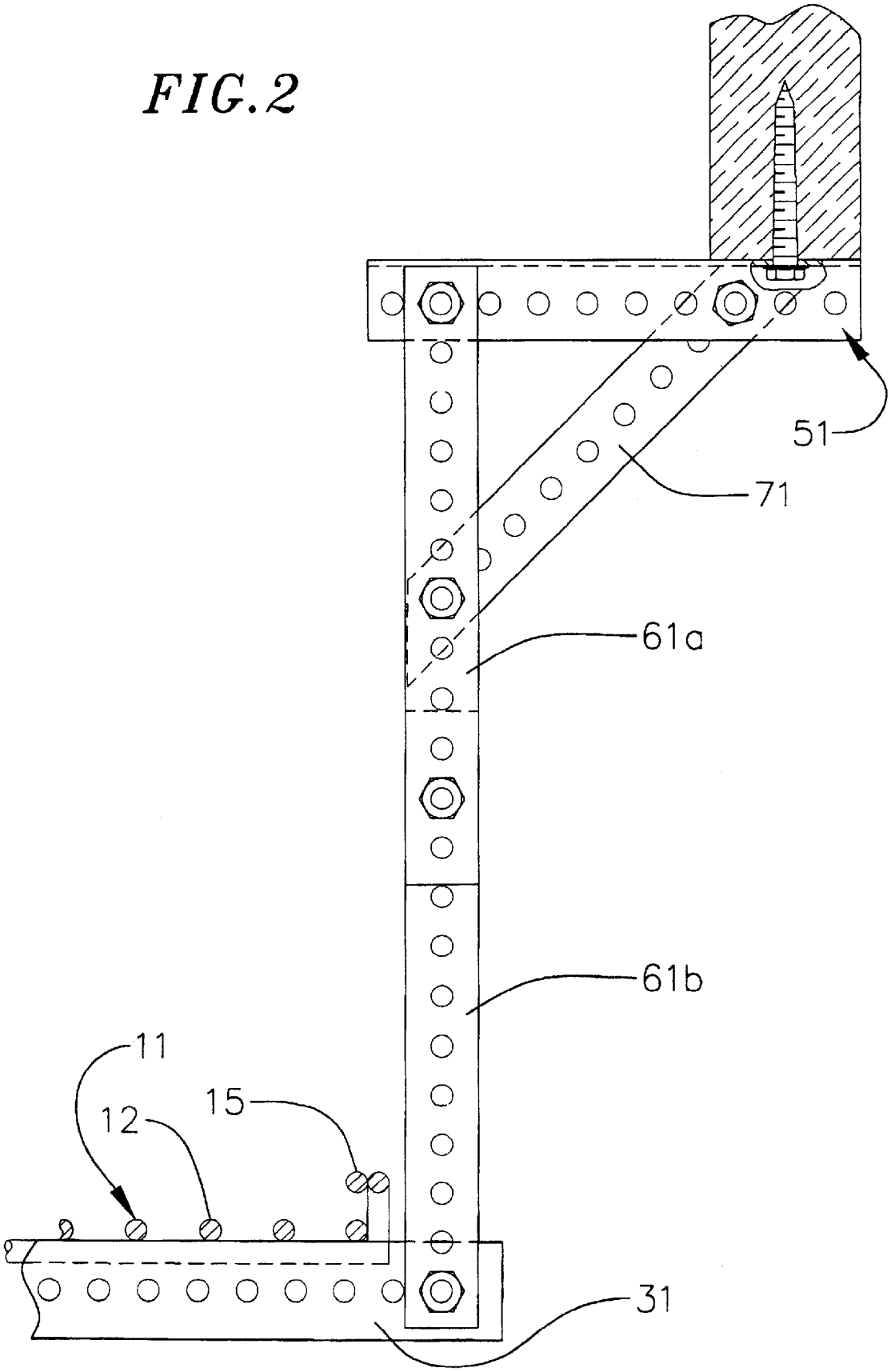
FIG. 2 is a perspective detail of one suspension substructure in accordance with the present invention.
Figure 3:
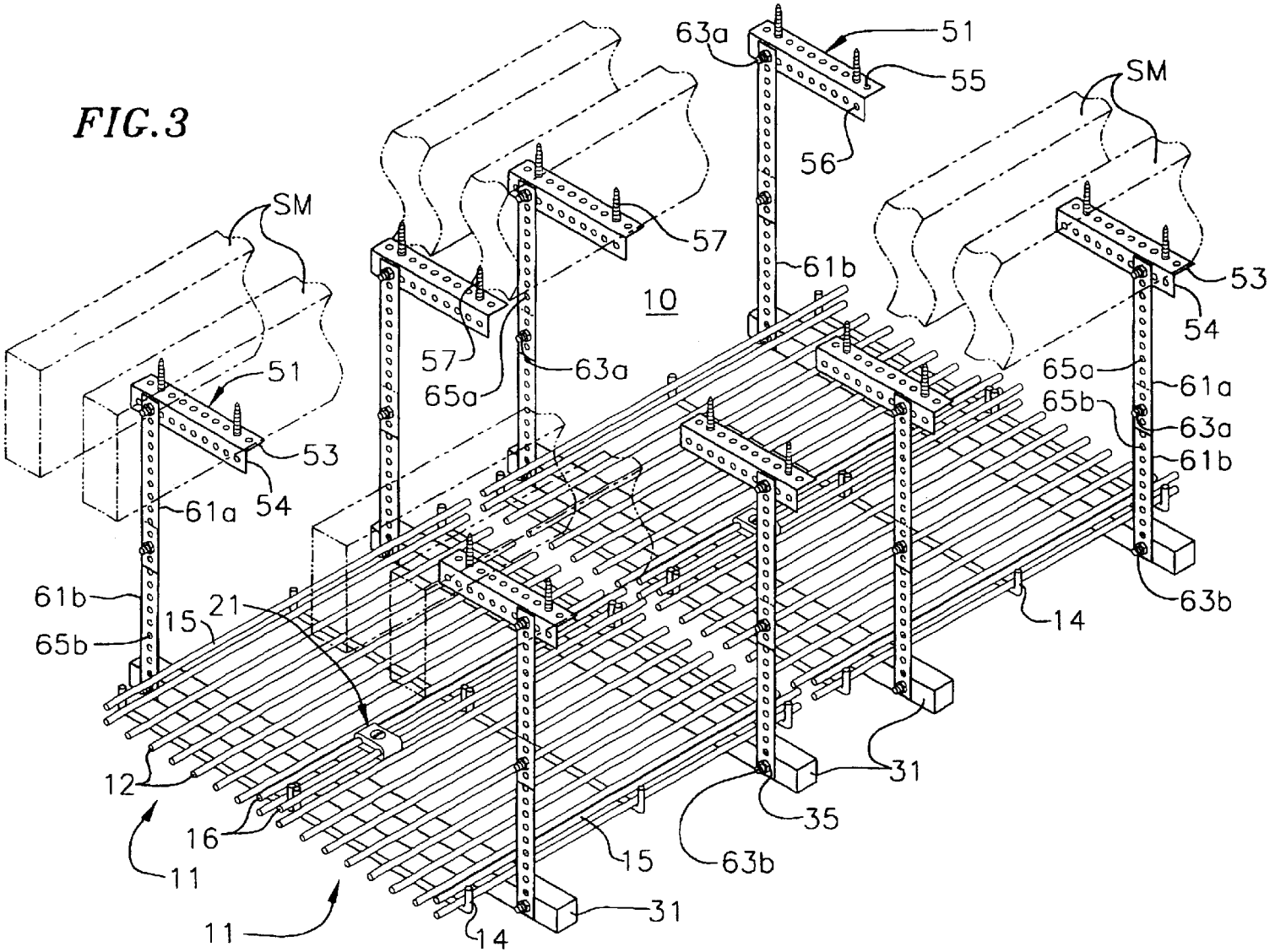
FIG. 3 is another perspective illustration of the inventive storage structure in its assembled form.
Figure 4:
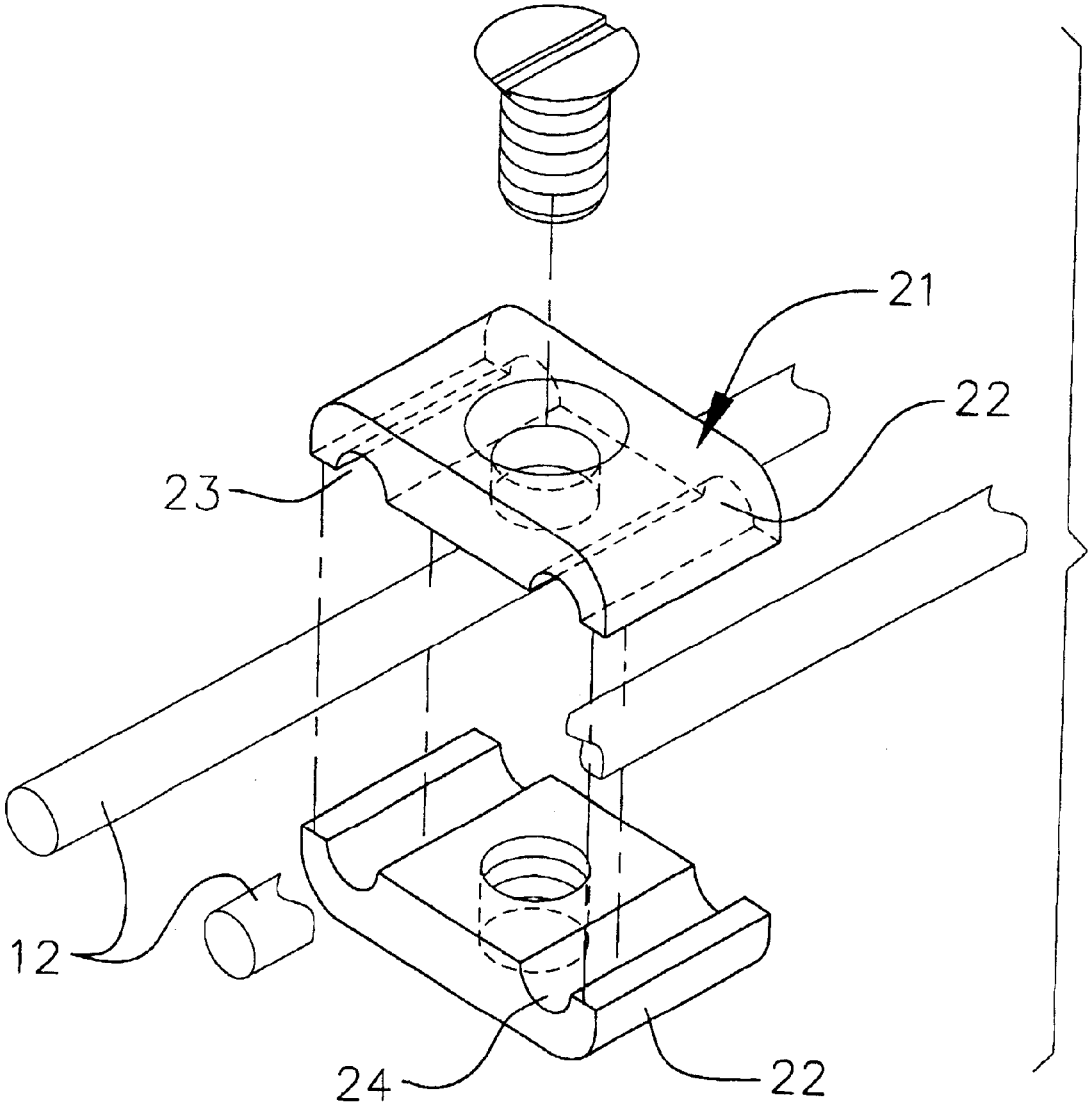
FIG. 4 is a perspective detail view illustrating a fastener arrangement useful with the present invention.

As shown in FIGS. 1–4 the inventive storage assembly, generally designated by the numeral 10, includes a horizontal storage platform formed by forming a plurality of welded wire panels 11. Each of the panels is defined by a set of parallel rods 12 welded to transverse edge and intermediate members 14 to form a welded wire surface element of a planform dimension in integer multiples of conventional structural beam spacing. Along both the longitudinal edges of the panel the transverse members 14 are bent orthogonally relative the panel plane to support off-set edge elements 15 and 16. In this manner both longitudinal edges of panel 11 are reinforced against bending.

Panels 11 may be joined at their edges to other adjacent panels to form a common storage surface, the joining being effected by fasteners 21 each comprising opposed clamping pieces 22 which together form parallel openings 23 and 24 that are clamped around the rods 12 or elements 14 of the adjacent panels. The joined panels 11 that form the common surface are then supported by several transverse pieces 31, each in the form of a square tube sectioned structural member provided with a set of drillings 35 at each end that are useful for fastening to a suspension structure further described below.

Those in the art will appreciate that the longitudinal dimension of pieces 31 will be in integer multiples of the width of panels 11. Thus, the length of pieces 31 is preferably either one or two widths of panel 11 resulting in an inventive overhead storage structure that allows for storage widths that are either one or two times the width of the panel. Furthermore, current construction practices, regulations and conventions have resulted in preferred spacing intervals of structural members that form a commercial or residential structure. Since these then define the hard points from which the stored articles can be suspended, the preference is to dimension the width and length of each panel 11 in integer multiples of this spacing interval. In this manner the resulting assembly is conveniently accommodated for direct attachment to structural elements.

The example illustrated herein provides transverse pieces 31 of a length that is equal to two (double) widths of panel 11. Thus the adjacent edge elements 15 or 16 of each panel align proximate the middle of each piece 31, and in order to fix this adjoining relationship the edge elements of each panel are joined to each other, between the pieces 31, by the clamping fasteners 21. In the manner panel 11, transverse pieces 31 and the clamping fasteners 21 combine to form a relatively rigid storage surface which can then be suspended at the end drillings 35.

Those in the art will appreciate further that while the structural spacing intervals are predetermined, the interior walls that separate the structure into forms or divisions do not always align with this structural spacing. As a result most of the prior art overhead storage systems either do not engage structural members or are deployed away from the walls. Accordingly, either the suspension strength suffers or the overhead storage is suspended in a manner that creates optical and physical incursion.

To avoid the foregoing disadvantages a set of adapters 51 can be provided, each again formed as an L-sectioned structural member defined by a horizontal surface 53 and a vertical surface 54. A set of drillings or holes 55 and 56 is provided respectively in the horizontal and vertical surfaces 53 and 54, and a fastener 57 is passed through the opening 55 that aligns subjacent a beam or structural member SM, to form a direct attachment thereto. Once so fastened the drillings 56 in the vertical surface are then useful in suspending the storage surface.

More precisely an upper strap 61 a provided with a row of holes 65*a* is fastened by a bolt and nut assembly 63*a* to a selected one of the drillings 56. A second, lower strap 61*b* provided with a row of openings 65*b* is then connected to the openings 35 in the ends of each transverse piece 31 by a nut and bolt assembly 63*b*. Once in position each strap 61*a* and 61*b* are then aligned relative each other and one or more of the openings 65*a* that align with the openings 65*b* are secured to each other by a further fastener set 67, connecting straps 61 a and 61 b together. Accordingly, adjustments can be made in the length of each suspension accommodating any height variation in the structural beams.

In those instances where substantial bending loads are created in the adapter 51, as a result of the mismatch in the suspension and beam geometry, triangulation straps 71 can be utilized. Once again each triangulation strap 71 is provided with a row of drillings or holes 75 along its length with the upper hole then fastened by a fastener set 76 to the opening 56 that is in most proximate alignment relative the beam. One of the other holes 75 can then be fastened to a selected hole 65*b*, resolving the bending moment. In this manner a light, conveniently assembled storage structure is formed that is directly engaged to the structural elements of a building.

While reference is made to welded structures, such are exemplary only. The foregoing assembly may be implemented in various material structures, and components thereof may be variously fabricated in all known material combinations. Moreover, while the foregoing description illustrates even hole spacing in the suspension elements unequal spacing may be utilized to provide further height adjustment convenience.

Obviously many modifications and variations can be effected without departing from the spirit of the invention set out herein. It is therefore intended that the scope of the invention be determined solely by the claims appended hereto.

We claim:

1. A storage assembly conformed for attachment to an overhead structure of a building, comprising:

a planar panel structure defined by a plurality of elongate elements aligned in parallel relative each other, said panel structure includes one or more individual panels comprising said elongate elements;

an attachment clamp conformed to engage one outermost of said elongate elements in one of said panels to an adjacent one of said elements in another said panel;

a plurality of transverse support pieces aligned subjacent said panel structure in transverse alignment relative said elongate elements, each said support piece projecting beyond said panel structure at both ends thereof, said transverse support pieces are each of a length that is an integer multiple of the transverse dimension of said panel;

a corresponding plurality of suspension assemblies each defined by an upper and a lower end and each releasably secured at said lower end thereof to a corresponding end of said transverse support pieces and operatively attached at said upper end to said overhead structure, each of said suspension assemblies includes an upper and a lower strap respectively defining said upper and lower ends, each said strap including a plurality of spaced openings, and fastening means conformed to engage a selected one of said openings in said upper strap to an opening in said lower strap; and adaptor means interposed between said upper ends of each said suspension assembly and said overhead structure for transferring load therebetween.

2. Apparatus according to claim 1, wherein:

each said outermost element of each said panel is fixed in an off-set, spaced alignment relative the plane of said panel.

3. Apparatus according to claim 2, wherein: said transverse support piece is of a hollow, square section.

4. Apparatus according to claim 1, further comprising:

a triangulation member connected between said suspension and said adaptor for controlling the bending deflections therebetween.

5. A storage assembly conformed for attachment to an overhead structure of a building, comprising:

a planar support surface including a plurality of generally planar panels each defined by a plurality of elongate elements aligned in parallel relative each other, outermost elements of each said panel being fixed in an off-set, spaced alignment relative the plane of said panel, each said panel being secured to an adjacent panel;

a plurality of transverse support pieces aligned subjacent said support surface in transverse alignment relative said elongate elements, each said support piece projecting beyond said support surface at both ends thereof;

a corresponding plurality of suspension assemblies each defined by an upper and a lower end and each secured at said lower end thereof to a corresponding end of said transverse support pieces and operatively attached at said upper end to said overhead structure; and adaptor means interposed between said upper ends of each said suspension assembly and said overhead structure for transferring load therebetween.

6. Apparatus according to claim 5, wherein:

said panels are secured to each other by an attachment clamp conformed to engage said outermost one of said elongate elements in one of said panels to an adjacent one of said elements in another said panel.

7. Apparatus according to claim 6, wherein:

each said support member includes an upper and a lower strap respectively defining said upper and lower ends, each said strap including a plurality of spaced openings, and fastening means conformed to engage a selected one of said openings in said upper strap to an opening in said lower strap.

8. Apparatus according to claim 7, further comprising:

a triangulation member connected between said suspension and said adaptor for controlling the bending deflections therebetween.

9. An overhead storage structure useful in providing selectively erected overhead storage suspended from an overhead structure, comprising:

a planar support surface structure defined by a plurality of panels each including elongate elements aligned in parallel relative each other, said panels are secured to each other by an attachment clamp conformed to engage said outermost one of said elongate elements in one of said panels to an adjacent one of said elements in another said panel;

a plurality of transverse support pieces aligned subjacent said support surface in transverse alignment relative said elongate elements, each said support piece projecting beyond said support surface at both ends thereof;

a corresponding plurality of suspension assemblies each defined by an upper and a lower end and each releasably secured at said lower end thereof to a corresponding end of said transverse support pieces and operatively attached at said upper end to said overhead structure; and adaptor means interposed between said upper ends of each said suspension assembly and said overhead structure for transferring load therebetween.

10. Apparatus according to claim 9, wherein:

each said suspension assembly includes an upper and a lower strap respectively defining said upper and lower ends, each said strap including a plurality of spaced openings, and fastening means conformed to engage a selected one of said openings in said upper strap to an opening in said lower strap.

11. Apparatus according to claim 10, further comprising:

a triangulation member connected between each said suspension assembly and each said adaptor for controlling the bending deflections therebetween.

* * * * *